US012460334B2

(12) United States Patent
Hombroek et al.

(10) Patent No.: US 12,460,334 B2
(45) Date of Patent: Nov. 4, 2025

(54) LAUNDRY WASHING MACHINE WITH AUTOMATIC TEMPERATURE CONTROL

(71) Applicant: Midea Group Co., Ltd., Foshan (CN)

(72) Inventors: Phillip C. Hombroek, Prospect, KY (US); Davis West, Covington, KY (US); Dylan Nicholson, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 385 days.

(21) Appl. No.: 18/078,918

(22) Filed: Dec. 9, 2022

(65) Prior Publication Data

US 2024/0191416 A1 Jun. 13, 2024

(51) Int. Cl.

| | |
|---|---|
| ***D06F 33/34*** | (2020.01) |
| ***D06F 34/18*** | (2020.01) |
| ***D06F 34/24*** | (2020.01) |
| *D06F 39/08* | (2006.01) |
| *D06F 103/00* | (2020.01) |
| *D06F 103/04* | (2020.01) |
| *D06F 103/16* | (2020.01) |
| *D06F 103/18* | (2020.01) |

(Continued)

(52) U.S. Cl.

CPC ..... *D06F 33/34* (2020.02); *D06F 34/18* (2020.02); *D06F 34/24* (2020.02); *D06F 39/087* (2013.01); *D06F 2103/00* (2020.02); *D06F 2103/04* (2020.02); *D06F 2103/16* (2020.02); *D06F 2103/18* (2020.02); *D06F 2105/02* (2020.02); *D06F 2105/04* (2020.02)

(58) Field of Classification Search

CPC ..... D06F 33/34; D06F 34/18; D06F 34/24; D06F 39/087; D06F 2103/00; D06F 2103/04; D06F 2103/16; D06F 2103/18; D06F 2105/02; D06F 2105/04

See application file for complete search history.

(56) References Cited

U.S. PATENT DOCUMENTS 4,503,575 A 3/1985 Knoop et al.
5,271,251 A * 12/1993 Kovich ..... D06F 23/04 68/171

(Continued)

FOREIGN PATENT DOCUMENTS

DE 102017103196 A1 8/2018
WO 2013050345 A1 4/2013

OTHER PUBLICATIONS

Biermayer, Peter J.; "Energy and Water Saving Potential of Dishwashers and Clothes Washers: An Update"; retrieved from https://escholarship.org/uc/item/5nr6t3z5; Lawrence Berkeley National Laboratory; dated Aug. 1, 1996.

(Continued)

*Primary Examiner* — Joseph L. Perrin
(74) *Attorney, Agent, or Firm* — Gray Ice Higdon

(57) ABSTRACT

A laundry washing machine and method control a temperature of water used in a wash cycle based at least partially on the weight of a load being washed. A volume of hot water and a volume of cold water to be added to the wash tub to provide a target temperature of water in the wash tub may be determined and a hot inlet valve and a cold inlet valve may be controlled to respectively add the determined volume of hot water and determined volume of cold water to the wash tub.

21 Claims, 4 Drawing Sheets

(51) Int. Cl.
*D06F 105/02* (2020.01)
*D06F 105/04* (2020.01)

(56) References Cited

U.S. PATENT DOCUMENTS 5,439,019 A * 8/1995 Quandt ..... D06F 39/088 68/12.22
5,768,728 A 6/1998 Harwood et al.
6,327,730 B1 * 12/2001 Corbett ..... D06F 33/00 68/12.22
6,499,321 B1 * 12/2002 Rhodes ..... D06F 39/088 68/12.22
6,634,048 B1 10/2003 Hornung et al.
7,370,495 B2 5/2008 Johnson
7,784,133 B2 8/2010 Bang et al.
7,841,217 B2 11/2010 Lueckenbach et al.
8,713,975 B2 5/2014 Motamedi et al.
10,023,990 B2 7/2018 Pollett
10,273,622 B2 4/2019 Hombroek
10,612,175 B2 4/2020 Hombroek
11,230,803 B2 1/2022 Hombroek et al.
11,371,175 B2 6/2022 Hombroek
11,479,897 B1 10/2022 Hooker
2005/0044641 A1 3/2005 Hyeong
2008/0172804 A1 * 7/2008 Vanhazebrouck ..... D06F 33/34 8/158
2012/0304395 A1 * 12/2012 Griswold ..... D06F 33/34 68/200
2015/0067970 A1 3/2015 Kim
2015/0292138 A1 10/2015 Leonard et al.
2018/0002856 A1 * 1/2018 Hombroek ..... D06F 39/087
2022/0034015 A1 2/2022 David et al.
2023/0243081 A1 * 8/2023 Lee ..... D06F 39/085 68/3 R

OTHER PUBLICATIONS

Biermayer, Peter J.; "Design Options for Clothes Washers"; retrieved from https://escholarship.org/uc/item/90x4378b; Lawrence Berkeley National Laboratory; dated Oct. 1, 1996.
Hombroek et al., U.S. Appl. No. 17/547,703, filed Dec. 10, 2021.
Hombroek et al., U.S. Appl. No. 17/825,662, filed May 26, 2022.

* cited by examiner

LAUNDRY WASHING MACHINE WITH AUTOMATIC TEMPERATURE CONTROL

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. The settings cycle can have an appreciable effect on washing performance, as well as on energy and/or water consumption, so it is generally desirable for the settings used by a laundry washing machine to appropriately match the needs of each load washed by the machine.

Some laundry washing machines also support user selection of load types, typically based on the types of fabrics and/or items in the load. Some laundry washing machines, for example, have load type settings such as colors, whites, delicates, cottons, permanent press, towels, bedding, heavily soiled items, etc. These manually-selectable load types generally represent specific combinations of settings that are optimized for particular load types so that a user is not required to select individual values for each of the controllable settings of a laundry washing machine.

While manual load type selection in many cases simplifies a user's interaction with a laundry washing machine, such manual selection still can lead to suboptimal performance due to, for example, user inattentiveness or lack of understanding. Therefore, a significant need continues to exist in the art for an automated manner of optimizing the performance of a laundry washing machine for different types of loads, as well as reducing the burden on users when interacting with a laundry washing machine.

One particular area in which laundry washing machine performance may be sub-optimal is control over water temperature. Many laundry washing machines, for example, allow a user or a predetermined wash cycle type to select a broad temperature range, e.g., "hot," "warm," "cold," etc. However, due to variations in the pressure and temperature of the hot and cold water inlets to a laundry washing machine, as well as the size of the load in the laundry washing machine, it can be difficult to achieve even these broad temperature ranges. A need therefore continues to exist for a manner of more precisely controlling the temperature of water used in a laundry washing machine.

SUMMARY

The invention addresses these and other problems associated with the art by providing in some aspects a laundry washing machine and method that control a temperature of water used in a wash cycle based at least partially on the weight of a load being washed. In particular, a volume of hot water and a volume of cold water to be added to the wash tub to provide a target temperature of water in the wash tub may be determined, and a hot inlet valve and a cold inlet valve may be controlled to respectively add the determined volume of hot water and determined volume of cold water to the wash tub.

Therefore, consistent with one aspect of the invention, a laundry washing machine may include a wash tub disposed within a housing, a water inlet configured to dispense water into the wash tub, the water inlet including a hot water valve and a cold water valve respectively configured to control a flow of hot water and a flow of cold water into the wash tub, a weight sensor positioned to sense at least a portion of a weight associated with the wash tub, and a controller coupled to the water inlet and the weight sensor, the controller configured to determine a weight associated with the wash tub using the weight sensor after a load has been added to the wash tub, determine a volume of hot water and a volume of cold water to be added to the wash tub to provide a target temperature of water in the wash tub based at least in part on the determined weight associated with the wash tub, and control the hot water valve and the cold water valve during a wash cycle to respectively add the determined volume of hot water and determined volume of cold water to the wash tub.

In some embodiments, the controller is configured to determine the weight associated with the wash tub by determining a weight of the load added to the wash tub. Also, in some embodiments, the controller is further configured to determine a total volume of water to be added to the wash tub based at least in part on the determined weight of the load. Further, in some embodiments, the controller is configured to determine the total volume of water to be added to the wash tub based at least in part on the determined weight of the load using a polynomial function including a plurality of empirically determined coefficients.

In some embodiments, the controller is further configured to dynamically select a load type for the load added to the wash tub from among a plurality of load types, and to determine the target temperature based at least in part on the dynamically selected load type. In addition, some embodiments may also include a fluid level sensor configured to sense a fluid level in the wash tub, and the controller is further configured to initiate an initial fill phase of the wash cycle by controlling the water inlet to dispense water into the wash tub and to dynamically select the load type during the initial fill phase of the wash cycle. In some embodiments, the controller is configured to dynamically select the load type based at least in part on a first time at which the fluid level sensor senses a predetermined fluid level while the controller controls the water inlet to dispense water into the wash tub and a peak time at which the fluid level sensor senses a stabilization of fluid level after the controller controls the water inlet to stop dispensing water into the wash tub.

In addition, in some embodiments, the controller is configured to control the water inlet to dispense an initial volume of water into the wash tub in association with dynamically selecting the load type. Moreover, in some embodiments, the controller is configured to dispense the initial volume of water by controlling the cold water valve to dispense the initial volume of water and to thereafter dispense the determined total volume of water to be added to the wash tub by controlling the hot water valve to add the determined volume of hot water to the wash tub and thereafter controlling the cold water valve to add the determined volume of cold water to the wash tub. In some embodiments, the controller is configured to dispense the initial volume of water and dispense the determined total volume of water to be added to the wash tub by cycling the hot water valve and the cold water valve a maximum of three times.

Moreover, in some embodiments, the controller is configured to determine the volume of hot water using the equation:

$$V_{hot} = \frac{(T_{target} * (V_{initial} + V_{total})) - (T_{cold} * V_{initial}) - (T_{cold} * V_{total})}{-T_{cold} + T_{hot}}$$

where $V_{hot}$ is the determined volume of hot water, $T_{target}$ is the target temperature, $V_{initial}$ is the initial volume of water, $V_{total}$ is the determined total volume of water to be added to the wash tub, $T_{cold}$ is a temperature of the cold water supplied by the cold water valve, and $T_{hot}$ is a temperature of the hot water supplied by the hot water valve.

In some embodiments, the controller is configured to determine the volume of cold water using the equation:

$$V_{cold}=V_{total}-V_{hot}$$

In addition, in some embodiments, the controller is configured to determine the volume of hot water and to determine the volume of cold water using an estimated temperature of the hot water dispensed by the hot water valve and an estimated temperature of the cold water dispensed by the cold water valve. In some embodiments, the controller is configured to determine the volume of hot water and to determine the volume of cold water using a hot water delay representing a duration or volume of non-hot water being dispensed upon initial activation of the hot water valve.

Some embodiments may further include one or more temperature sensors configured to sense a temperature of the hot water dispensed by the hot water valve and a temperature of the cold water dispensed by the cold water valve, and the controller is configured to perform a calibration operation to determine a temperature of the hot water dispensed by the hot water valve and determine a temperature of the cold water dispensed by the cold water valve using the one or more temperature sensors.

Also, in some embodiments, the controller is configured to perform the calibration operation by activating the hot water valve to dispense a first volume of hot water into the wash tub and determining the temperature of the first volume of hot water using the one or more temperature sensors, draining the first volume of hot water from the wash tub, activating the cold water valve to dispense a second volume of cold water into the wash tub and determining the temperature of the second volume of cold water using the one or more temperature sensors, and draining the second volume of cold water from the wash tub.

In some embodiments, the controller is further configured to perform the calibration operation by determining a hot water delay representing a duration or volume of non-hot water being dispensed upon initial activation of the hot water valve. In addition, in some embodiments, the controller is configured to perform the calibration operation during initial setup of the laundry washing machine.

Also, in some embodiments, the controller is configured to control the hot water valve to add the determined volume of hot water by opening the hot water valve for a first predetermined time determined based upon an estimated flow rate for the hot water valve, and to control the cold water valve to add the determined volume of cold water by opening the cold water valve for a second predetermined time determined based upon an estimated flow rate for the cold water valve. Moreover, in some embodiments, the controller is configured to control the hot water valve to add the determined volume of hot water by opening the hot water valve for a first predetermined time determined based upon a determined flow rate for the hot water valve, to control the cold water valve to add the determined volume of cold water by opening the cold water valve for a second predetermined time determined based upon a determined flow rate for the cold water valve, and to determine the determined flow rate for the hot water valve and the determined flow rate for the cold water valve by activating the hot water valve to dispense a first volume of hot water into the wash tub, determining a first rate of level change in the wash tub using a fluid level sensor configured to sense a fluid level in the wash tub, and determining the determined flow rate for the hot water valve from the determined first rate of level change, draining the first volume of hot water from the wash tub, activating the cold water valve to dispense a second volume of cold water into the wash tub, determining a second rate of level change in the wash tub using the fluid level sensor, and determining the determined flow rate for the cold water valve from the determined second rate of level change, and draining the second volume of cold water from the wash tub.

Consistent with another aspect of the invention, a laundry washing machine may include a wash tub disposed within a housing, a fluid level sensor configured to sense a fluid level in the wash tub, a water inlet configured to dispense water into the wash tub, the water inlet including a hot water valve and a cold water valve respectively configured to control a flow of hot water and a flow of cold water into the wash tub, and a controller coupled to the water inlet and the weight sensor, the controller configured to perform a wash cycle for a load disposed in a wash tub by initiating an initial fill phase of the wash cycle by controlling the water inlet to dispense a first volume of water into the wash tub, dynamically selecting a load type for the load during the initial fill phase, determining a target temperature based at least in part on the dynamically selected load type, determining a total volume of water to be added to the wash tub after the first volume of water has been added to the wash tub, determining a volume of hot water and a volume of cold water to be added to the wash tub based at least in part upon the target temperature and the determined total volume of water to be added to the wash tub, and controlling the hot water valve and the cold water valve to respectively add the determined volume of hot water and determined volume of cold water to the wash tub.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
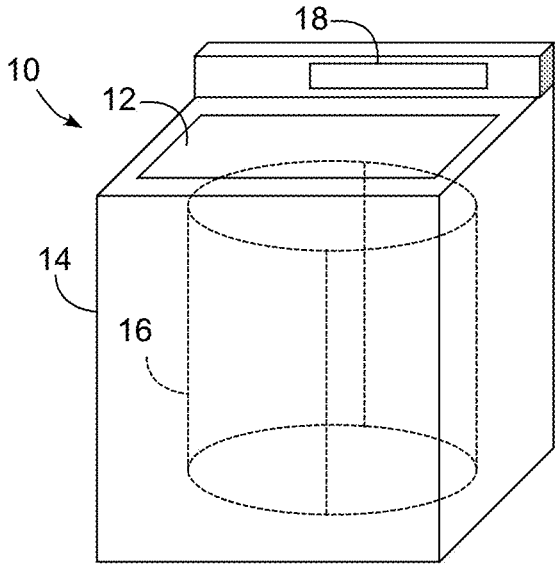
FIG. 1 is a perspective view of a top-load laundry washing machine consistent with some embodiments of the invention.

Embodiments consistent with the invention may control a temperature of water used in a wash cycle based at least partially on the weight of a load being washed, in part by determining a volume of hot water and a volume of cold water to be added to the wash tub to provide a target temperature of water in the wash tub and controlling a hot inlet valve and a cold inlet valve to respectively add the determined volume of hot water and determined volume of cold water to the wash tub. Furthermore, a target temperature may be determined in some embodiments based at least in part upon a load type for the load, which in some embodiments may be dynamically determined during an initial fill operation performed during the wash cycle.

In this regard, a load type may be considered to represent one of a plurality of different characteristics, categories, classes, subclasses, etc. that may be used to distinguish different loads from one another, and for which it may be desirable to define particular operational settings or combinations of operational settings for use in washing loads of that particular load type. In the illustrated embodiments, load types are principally distinguished based upon different fabric types (e.g., natural, cotton, wool, silk, synthetic, polyester, permanent press, wrinkle resistant, blends, etc.), and optionally, based on different article types (e.g., garments, towels, bedding, delicates, etc.). It will be appreciated, however, that load types may be defined based upon additional or alternative categorizations, e.g., color (colors, darks, whites, etc.); durability (delicates, work clothes, etc.), soil level (lightly soiled, normally soiled, heavily soiled loads, etc.), among others. Load types may also represent categories of loads that are unnamed, and that simply represent a combination of characteristics for which certain combinations of operational settings may apply, particularly as it will be appreciated that some loads may be unsorted and may include a combination of different items that themselves have different characteristics. Therefore, in some embodiments, a load type may be associated with a combination of operational settings that will be applied to a range of different loads that more closely match that load type over other possible load types.

An operational setting, in this regard, may include any number of different configurable aspects of a wash cycle performed by a laundry washing machine including, but not limited to, a wash water temperature, a rinse water temperature, a wash water amount, a rinse water amount, a speed or stroke of agitation during washing and/or rinsing, a spin speed, whether or not agitation is used during washing and/or rinsing, a duration of a wash, rinse, soak, or spin phase of a wash cycle, a number of repeats of a wash, rinse, soak or spin phase, selection between different rinse operation types such as a spray rinse operation or a deep fill rinse operation, pre-treatment such as soaking over time with a prescribed water temperature and specific agitation stroke, a duration of a drain operation, etc.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
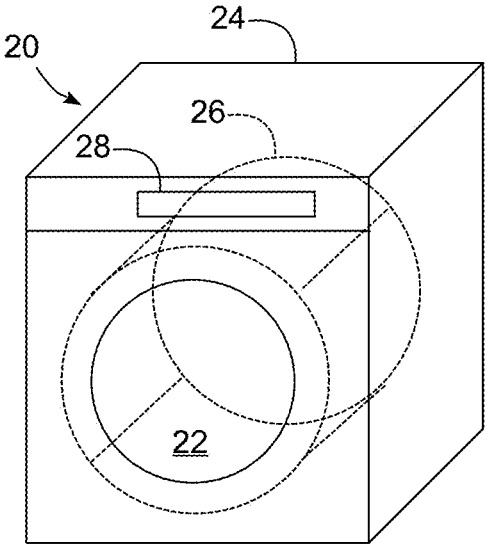
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
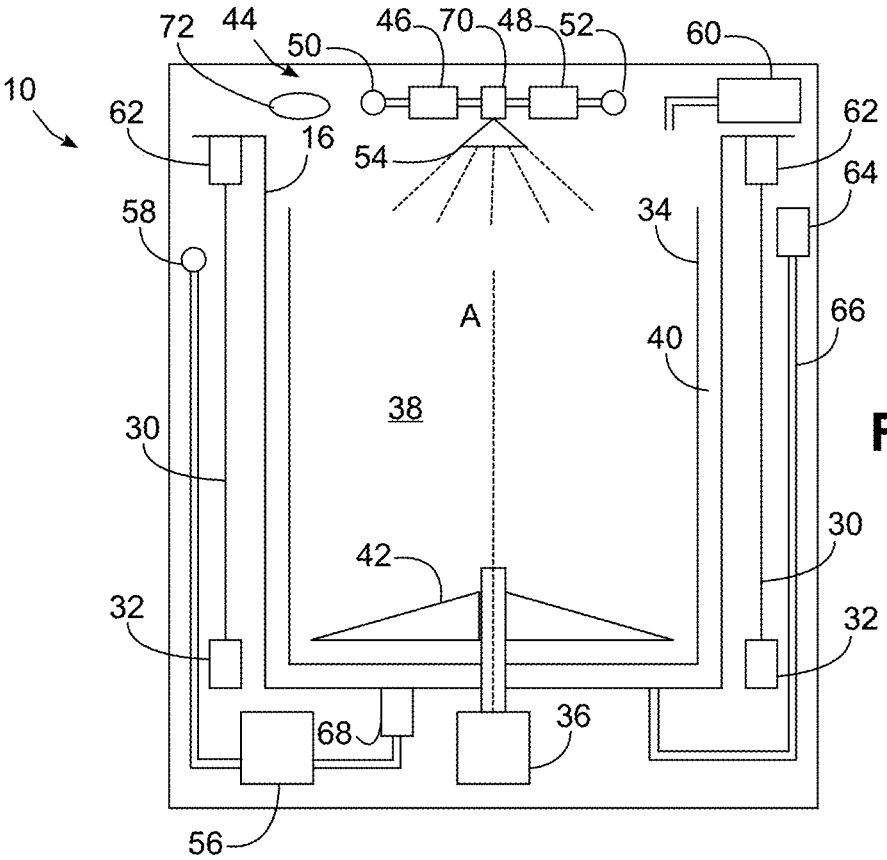
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments an agitator 42 such as an impeller, auger or other agitation element may be disposed in the interior 38 of wash basket 34 to agitate items within wash basket 34 during a wash cycle. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold water valves 46, 48 may be coupled to external hot and cold water supplies through hot and cold inlets 50, 52, and may output to one or more nozzles 54 to dispense water of varying temperatures into wash tub 16. In addition, a pump or drain system 56, e.g., including a pump and an electric motor, may be coupled between a low point, bottom or sump in wash tub 16 and an outlet 58 to discharge greywater from wash tub 16. In some embodiments, it may be desirable to utilize multiple nozzles 54, and in some instances, oscillating nozzles 54, such that water dispensed into the wash tub is evenly distributed over the top surface of the load. As will become more apparent below, in some instances, doing so may maximize the amount of water absorbed by the load prior to water reaching the bottom of the wash tub and being sensed by a fluid level sensor.

In some embodiments, laundry washing machine 10 may also include a dispensing system 60 configured to dispense detergent, fabric softener and/or other wash-related products into wash tub 16. Dispensing system 60 may be configured in some embodiments to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Further, to support automated load type selection or otherwise to support automated selection of various operational settings such as the various volumes of water and the water temperature as discussed hereinafter, laundry washing machine 10 also includes a weight sensing system, and optionally various additional sensors such as a fluid level sensor, a turbidity sensor, a conductivity sensor, a flow sensor, a color detection sensor, etc., as will be discussed in greater detail below. A weight sensing system may be used to sense the mass or weight of the contents of wash tub 16, e.g., when the wash tub is filled with water or even prior to filling the wash tub. In the illustrated embodiment, for example, a weight sensing system consistent with the invention may be implemented in laundry washing machine 10 at least in part using one or more weight sensors 62 that support wash tub 16 on one or more corresponding support rods 30. Each weight sensor 62 may be an electro-mechanical sensor that outputs a signal that varies with a displacement based on applied force (here, also representative of load or weight), and thus outputs a signal that varies with the weight of the contents of wash tub 16. Multiple weight sensors 62 may be used in some embodiments, and in some embodiments, the weight sensors may be implemented using load cells, while in other embodiments, other types of transducers or sensors that generate a signal that varies with applied force, e.g., strain gauges, may be used. Furthermore, while weight sensors 62 are illustrated as supporting wash tub 16 on support rods 30, the weight sensors may be positioned elsewhere in a laundry washing machine to generate one or more signals that vary in response to the weight of the contents of wash tub 16. In some embodiments, for example, transducers may be used to support an entire laundry washing machine, e.g., one or more feet of a machine. Other types and/or locations of transducers suitable for generating a signal that varies with the weight of the contents of a wash tub will be apparent to one of ordinary skill in the art having the benefit of the instant disclosure. In addition, in some embodiments, a weight sensing system may also be used for vibration sensing purposes, e.g., to detect excessive vibrations resulting from an out-of-balance load. In other embodiments, however, no vibration sensing may be used, while in other embodiments, separate sensors may be used to sense vibrations. Further, in some embodiments, a single weight sensor employing a load cell or other transducer may be used (e.g., disposed proximate a corner of the housing), and the wash basket may be rotated when sensing the weight of the load such that a weight may be determined by averaging multiple force values captured during rotation of the wash basket.

A fluid level sensor may be used in some embodiments to generate a signal that varies with the level or height of fluid in wash tub 16. In the illustrated embodiment, for example, a fluid level sensor may be implemented using a pressure sensor 64 in fluid communication with a low point, bottom or sump of wash tub 16 through a tube 66 such that a pressure sensed by pressure sensor 64 varies with the level of fluid within the wash tub. It will be understood that the addition of fluid to the wash tub will generate a hydrostatic pressure within the tube that varies with the level of fluid in the wash tub, and that may be sensed, for example, with a piezoelectric or other transducer disposed on a diaphragm or other movable element. It will be appreciated that a wide variety of pressure sensors may be used to provide fluid level sensing, including, among others, combinations of pressure switches that trigger at different pressures. It will also be appreciated that fluid level in the wash tub may also be sensed using various non-pressure based sensors, e.g., optical sensors, float sensors, laser sensors, etc.

Additional sensors may also be incorporated into laundry washing machine 10. For example, in some embodiments, a temperature, turbidity and/or conductivity sensor 68 may be used to measure the temperature and/or the turbidity or clarity and/or the conductivity of the fluid in wash tub 16. In other embodiments, separate sensors may be used to measure turbidity, conductivity and/or temperature, and further, other sensors may be incorporated to measure additional fluid characteristics. In other embodiments, no temperature and/or turbidity and/or conductivity sensor may be used.

In addition, in some embodiments, a flow sensor 70 such as one or more flowmeters may be used to sense an amount of water dispensed into wash tub 16. In other embodiments, however, no flow sensor may be used. Instead, water inlet 44 may be configured with a static and regulated flow rate such that the amount of water dispensed is a product of the flow rate and the amount of time the water is dispensed, or alternatively, a calibration operation may be performed in some embodiments in order to determine a flow rate of one or both of water valves 46, 48 using pressure sensor 64 to sense a rate of change in fluid level over time. Therefore, in some embodiments, a timer may be used to determine the various volumes of water dispensed into wash tub 16.

In some instances, a color detection sensor 72 may be used to capture color composition data of one or more items of a load. In some embodiments, the color detection sensor 72 may be positioned to capture the color composition data as items are added to the wash tub 16. In some embodiments, the color detection sensor 72 may be an image sensor, or a camera.

Figure 4:
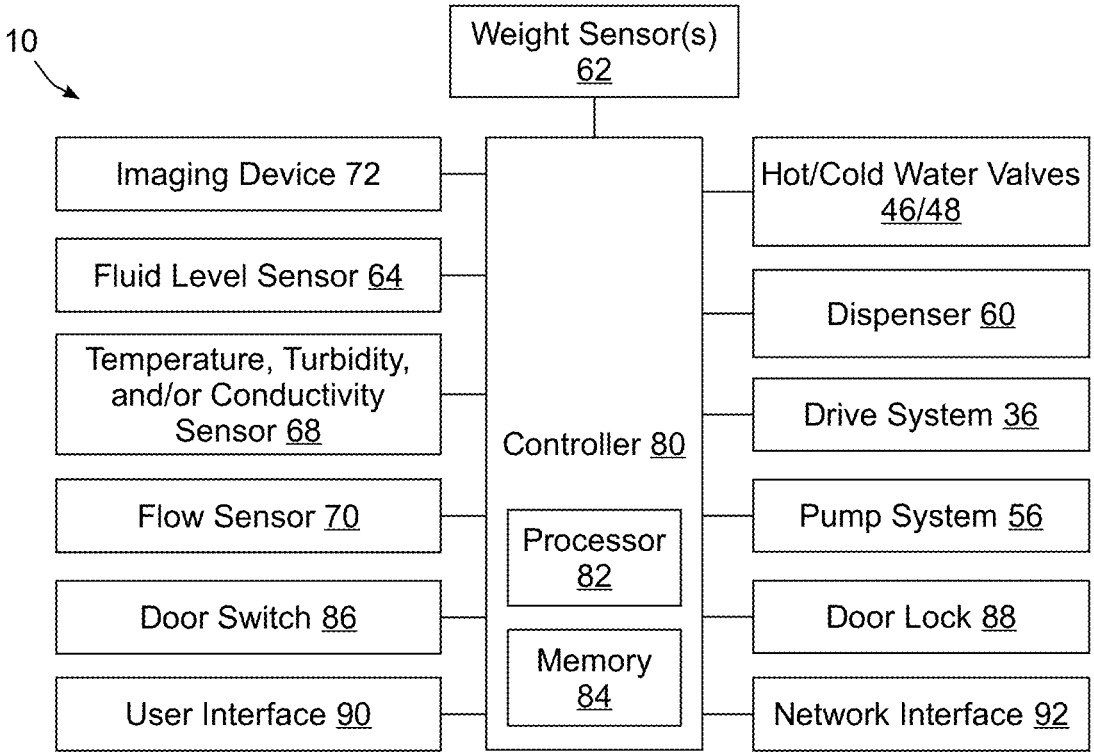
FIG. 4 is a block diagram of an example control system for the laundry washing machine of FIG. 1.

Now turning to FIG. 4, laundry washing machine 10 may be under the control of a controller 80 that receives inputs from a number of components and drives a number of components in response thereto. Controller 80 may, for example, include one or more processors 82 and a memory 84 within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80. Controller 80 may also be implemented as a microcontroller in some embodiments, and as such these terms are used interchangeably herein. Controller 80 may also include specialized circuit logic in some embodiments, which may be integrated into one or more integrated circuits in some embodiments, including into an integrated circuit that also incorporates one or more processors and/or memory (also referred to herein as a processor integrated circuit) and/or which may be separate from any integrated circuit (e.g., including logic circuitry on the same or a different module or circuit board).

As shown in FIG. 4, controller 80 may be interfaced with various components, including the aforementioned drive system 36, hot/cold water valves 46, 48, drain or pump system 56, weight sensor(s) 62, fluid flow/pressure sensor 64, temperature, turbidity and/or conductivity sensor 68, and flow sensor 70. In addition, controller 80 may be interfaced with additional components such as a door switch 86 that detects whether door 12 is in an open or closed position and a door lock 88 that selectively locks door 12 in a closed position. Moreover, controller 80 may be coupled to a user interface 90 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 80 may also be coupled to one or more network interfaces 92, e.g., for interfacing with external devices via wired and/or wireless networks such as Ethernet, Bluetooth, NFC, cellular and other suitable networks, including external devices such as end user computers, mobile phones, tablets, etc. and/or one or more cloud services. Additional components may also be interfaced with controller 80, as will be appreciated by those of ordinary skill having the benefit of the instant disclosure. Moreover, in some embodiments, at least a portion of controller 80 may be implemented externally from a laundry washing machine, e.g., within a mobile device, a cloud computing environment, etc., such that at least a portion of the functionality described herein is implemented within the portion of the controller that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Automatic Temperature Control

With many laundry washing machines, a water temperature used during a wash cycle (e.g., during a wash operation thereof) is generally reached by mixing a specific ratio of hot and cold water together depending on a temperature selection. The temperature selection is generally made between some combination of the following: tap cold, cold, warm, hot, extra hot, sanitizing, etc. With these temperature settings, the actual water temperature is generally not specified and the different temperature settings can vary at different times of the year, often depending on the season and the climate, and can also be affected by the delay in hot water getting from the hot water tank to the washer. Temperature selections can also be affected by the residential hot water temperature setpoint for a hot water tank or instantaneous hot water heater. For these reasons, the temperature settings are rarely met with precision, which can inhibit the ability to maximize wash performance for some types of loads.

Some laundry washing machines may use a temperature sensor to monitor the current temperature of water entering the wash tub, and if the water is below the desired temperature, more hot water will be added until the target temperature is met. With this method, however, the hot and cold water valves will generally cycle on and off repeatedly to meet the target temperature. Cycling the valves depending on the reading from the temperature sensor, however, can cause extensive stress on the valves as well as excessive noise.

In embodiments consistent with the invention, however, the weight of the load being washed may be used to determine a desired final volume of water to be dispensed into a wash tub, and from this desired final volume, volumes of hot water and cold water may also be determined in order to meet a desired target temperature for the water. In addition, if any water is added during an initial fill operation, e.g., for the purposes of determining a load type, that volume of water may be subtracted from the desired final volume of water to determine a total volume of water that needs to be added to the wash tub. Where no water is added in connection with determining load type, or otherwise added prior to determining the desired final volume of water to be dispensed into the wash tub, the determined total volume of water that needs to be added to the wash tub may be substantially equal to the desired final volume of water to be dispensed into the wash tub.

Figure 5:
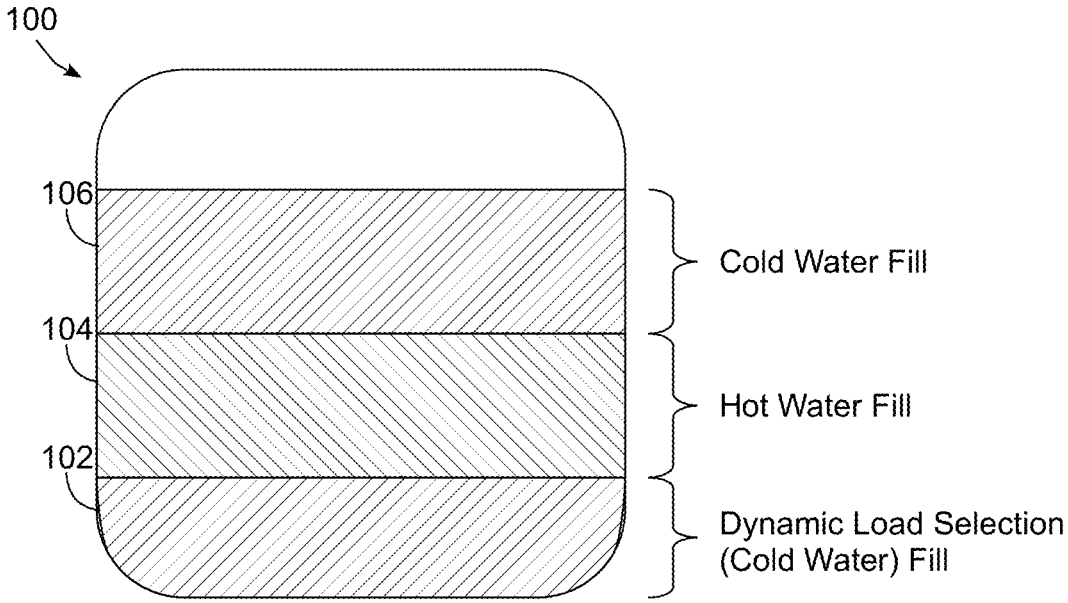
FIG. 5 is block diagram of a wash tub illustrating a three stage initial fill operation capable of being performed by the laundry washing machines of FIGS. 1-4.

In addition, in order to minimize cycling of the hot and cold water valves, the volumes of hot and/or cold water needed to reach the target temperature when the desired final volume of water is dispensed in the wash tub may be used to control the hot and/or cold water valves such that, for example, the determined volume of hot water may be dispensed in a single cycle of the hot water valve (where, in this context, one cycle for a water valve refers to a sequence of activating the water valve to begin dispensing water and then deactivating the water valve to cease dispensing water). In one embodiment discussed hereinafter, for example, and as illustrated in FIG. 5, an initial fill operation in a wash tub 100 during a wash cycle may include a first cycle 102 of the cold water valve to supply cold water used in dynamic load type selection, followed by a single cycle 104 of the hot water valve to supply the determined volume of hot water, and followed by a second cycle 106 of the cold water valve to supply the determined volume of cold water, resulting in a maximum of three total cycles of the hot and cold water valves during the initial fill operation.

It will be appreciated, however, that fewer or greater cycles of the hot and/or cold water valves may be used in other embodiments. Moreover, it will be appreciated that the hot and cold water valves may also be activated concurrently in some embodiments, rather than sequentially, such that in some embodiments more than one water valve may be activated at a time during at least a portion of the time that a volume of hot or cold water is being dispensed. In addition, while the embodiments discussed herein focus on controlling the volume and temperature of a wash operation of a wash cycle, i.e., the portion of the wash cycle where the load is agitated within a wash liquor formed by water and detergent, the techniques disclosed herein may be used to control other operations in a wash cycle in other embodiments, e.g., to control the volume and temperature of water used in a rinse operation.

In some embodiments, the volumes of hot and cold water to be added in order to add the determined total volume of water to be added to the wash tub to provide a target temperature of water in the wash tub may be determined by solving a system of linear equations. These linear equations may also be at least partially dependent on load weight and/or load type in some embodiments such that an optimum volume and temperature of wash water for a particular size and/or type of load may be obtained.

For example, it may be desirable in some embodiments to solve for the following two linear equations (1) and (2):

$$V_{total}=V_{cold}+V_{hot} \tag{1}$$

and $$T_{target}=\frac{(T_{cold}*(V_{inital}+V_{cold}))+(T_{hot}*V_{hot})}{V_{inital}+V_{cold}+V_{hot}} \tag{2}$$

where $V_{total}$ is a weight-dependent total volume of water to be added to the wash tub after any initial fill performed during dynamic load type selection in order to reach a desired final volume of water in the wash tub, $V_{cold}$ is the volume of cold water to be added to the wash tub, $V_{hot}$ is the volume of hot water to be added to the wash tub, $T_{target}$ is the target temperature, $T_{cold}$ is the cold water temperature, $T_{hot}$ is the hot water temperature, and $V_{initial}$ is the aforementioned initial volume of cold water added in association with dynamic load type selection.

Solving the system of linear equations, the volume of hot water to be added to the wash tub and the volume of cold water to be added to the wash tub may be calculated as shown below in equations (3) and (4):

$$V_{hot}=\frac{(T_{target}*(V_{initial}+V_{total}))-(T_{cold}*V_{initial})-(T_{cold}*V_{total})}{-T_{cold}+T_{hot}} \tag{3}$$

and $$V_{cold}=V_{total}-V_{hot} \tag{4}$$

It will be appreciated that other equations may be used in other alternatives, and that, for example, $V_{hot}$ and $V_{cold}$ may be determined independently in some embodiments, or $V_{cold}$ may be determined prior to determining $V_{hot}$, in a similar (but reverse) manner to equations (3) and (4).

In addition, in some embodiments, it may be desirable to account for a delay in delivering hot water to the wash tub when the hot water valve is first activated. It will be appreciated, for example, that a hot water heater in a home is often some distance from the laundry washing machine, such that any water that is in the hot water lines leading to the laundry washing machine (referred to herein as "non-hot water") may have cooled to room temperature if no hot water has been used for some period of time. Moreover, some homes include hot water recirculation circuits that substantially reduce the delay for hot water to reach faucets in the home, as well as a laundry washing machine. In some embodiments, therefore, it may be desirable to incorporate a predetermined duration or volume into the calculation of the volumes of hot and cold water to account for the non-hot water that is dispensed from the hot water valve upon initial activation.

In some embodiments, for example, this delay may be accounted for by modifying the value of $V_{initial}$ to be, rather than the initial volume of cold water added in association with dynamic load type selection, a summation of the initial volume of cold water added in association with dynamic load type selection and a volume of non-hot water that accounts for the time delay in the delivery of hot water to the laundry washing machine upon initial activation of the hot water valve, e.g., $V_{initial}=V_{dls}+V_{hwdelay}$, where $V_{dls}$ is the volume dispensed during dynamic load type selection and $V_{hwdelay}$ is the volume dispensed prior to the delivery of hot water to the laundry washing machine.

In other embodiments, compensation for the hot water delivery delay may be implemented in other manners. For example, in some embodiments, the hot water valve may be turned on for the delay period during the dynamic load type selection process to supply a portion of the cold water used in dynamic load type selection. In other embodiments, particularly where the volume of cold water is dispensed prior to the volume of hot water, $V_{hwdelay}$ may be subtracted from $V_{cold}$, such that the cold water valve is shut off prior to dispensing the complete volume of cold water and the hot water valve is activated such that a portion of the volume of cold water dispensed is cold water dispensed from the hot water valve.

The determination of the desired final volume of water to be dispensed into a wash tub, as noted above, may be based at least in part on the weight of the load in the wash tub. It will be appreciated, however, that various weights associated with a wash tub may be used in the determination of the desired final volume of water in different embodiments. A direct determination of load weight may be used in some embodiments, while in other embodiments, other weights, e.g., the weight of the wash tub including the load and/or any dispensed water, may be used.

Moreover, the manner in which the desired final volume of water to be dispensed may be determined may vary in different embodiments. For example, in one embodiment, a quadratic equation may be used to determine the final volume of water to be dispensed, such that the total amount of water to add to the wash tub ($V_{total}$) may be determined from the weight of the load (w) as follows:

$$V_{total}=(aw^2+bw+c)-V_{initial} \quad (5)$$

Coefficients a, b, and c may be determined empirically in some embodiments, and may be specific to particular models or designs of laundry washing machines. In other embodiments, other empirically derived functions may be used, e.g., based upon curve fitting or regression analysis for a particular model or design of laundry washing machine for different load weights and targeted water volumes. In addition, while quadratic Eq. (5) may be used in some embodiments, in other embodiments, various other polynomial functions including various combinations of coefficients, e.g., a linear function of the form Mx+b, may be used.

Figure 6:
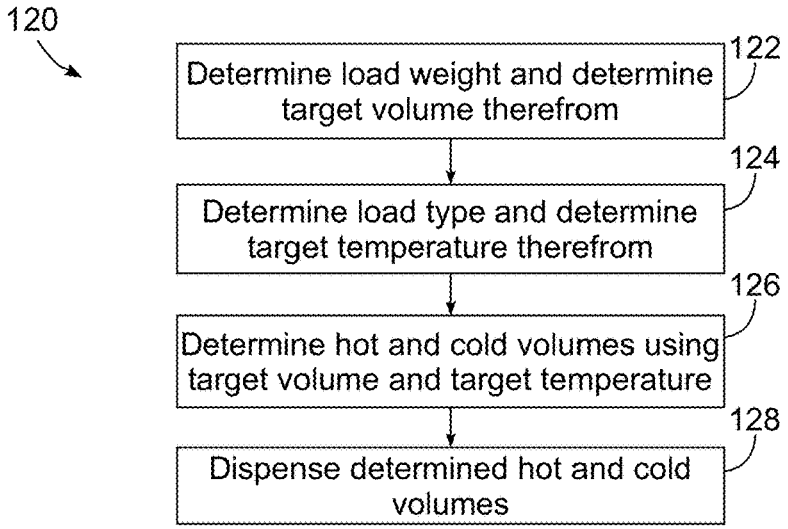
FIG. 6 is a flowchart illustrating an example operational sequence for an initial fill operation capable of being performed by the laundry washing machines of FIGS. 1-4.

Now turning to FIG. 6, an example operational sequence 120 for performing an initial fill operation is illustrated. In this operation sequence, a target volume for the initial fill operation is determined at least in part based upon a load weight, and a target temperature for the initial fill operation is determined at least in part based upon a load type, e.g., based on a fabric type and/or color. In block 122, a load weight is determined (e.g., using one or more weight sensors 62) and a target volume, e.g., a desired final volume of water to be dispensed during the initial fill operation, is determined using the determined load weight (e.g., using a quadratic equation as discussed above in connection with Eq. (5)). In block 124, a load type is determined, e.g., automatically using a dynamic load type selection algorithm, or alternatively, based upon a user selection of load type through one or more user controls, and a target temperature is determined at least in part using the determined load type (e.g., hot for whites or towels, cold for colors or delicates, warm for man-made fibers, etc.) In some embodiments, some water may be dispensed in block 124 in connection with determining the load type; however, in other embodiments no water may be dispensed in block 124.

Next, in block 126, volumes of hot and cold water are determined using the target volume and target temperature, e.g., in the manner discussed above in connection with Eqs. (3) and (4), with any initial volume of water dispensed in block 124 accounted for as discussed above. Then, in block 128, the determined hot and cold volumes are dispensed, by activating the hot and cold water valves in sequence (with hot water dispensed before cold water, or vice versa), or alternatively concurrently.

Figure 7:
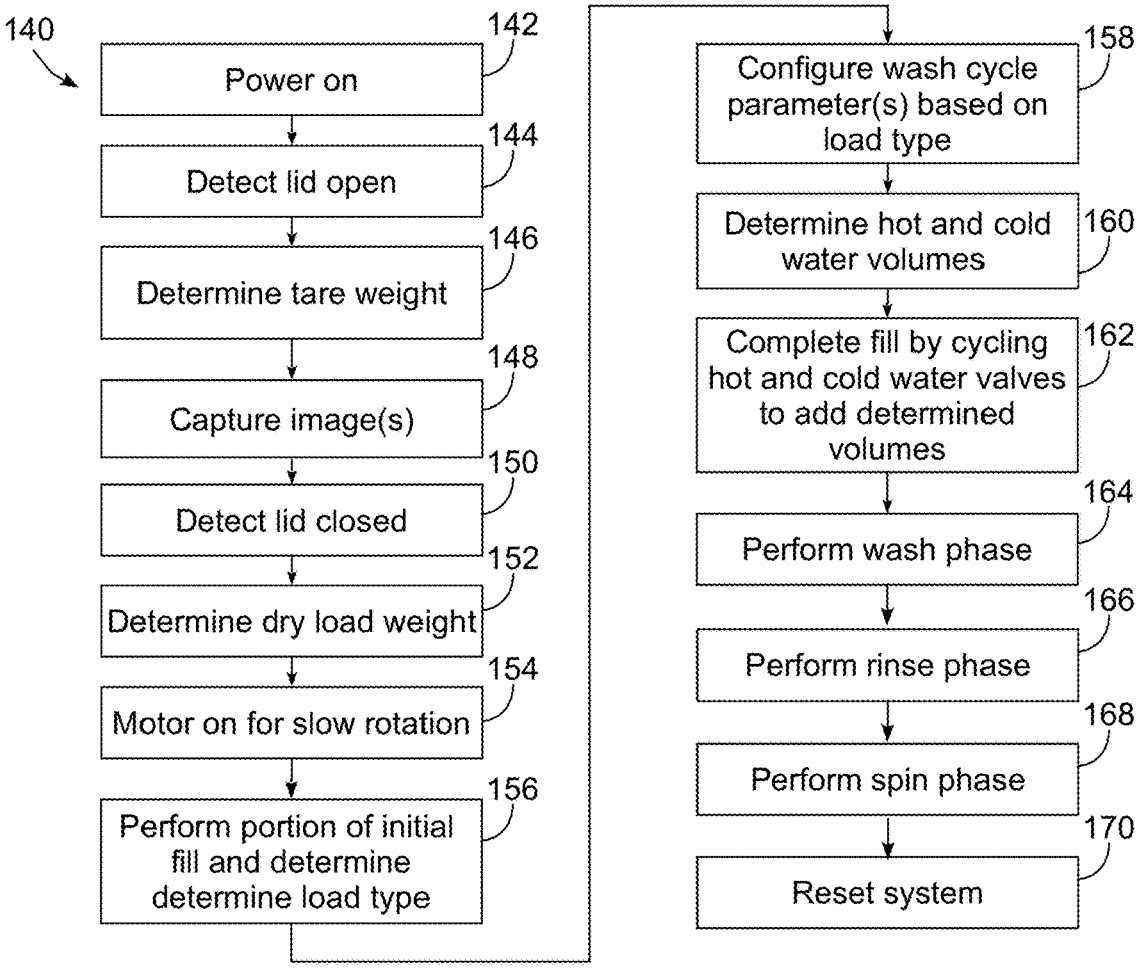
FIG. 7 is a flowchart illustrating an example operational sequence for implementing a wash cycle in the laundry washing machines of FIGS. 1-4.

FIG. 7 next illustrates an example operational sequence 140 for implementing a wash cycle in a laundry washing machine using utilizing automatic temperature control as discussed herein, and capable of being executed, for example, by controller 80. A typical wash cycle includes multiple phases, including an initial fill phase where the wash tub is initially filled with water, a wash phase where a load that has been placed in the wash tub is washed by agitating the load with a wash liquor formed from the fill water and any wash products added manually or automatically by the washing machine, a rinse phase where the load is rinsed of detergent and/or other wash products (e.g., using a deep fill rinse where the wash tub is filled with fresh water and the load is agitated and/or a spray rinse where the load is sprayed with fresh water while spinning the load), and a spin phase where the load is spun rapidly while water is drained from the wash tub to reduce the amount of moisture in the load.

It will be appreciated that wash cycles can also vary in a number of respects. For example, additional phases, such as a pre-soak phase, may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different rinse operation types, different spin speeds, different water amounts, different wash product amounts, etc.

In this example sequence, a load type may be dynamically determined by a controller of the laundry washing machine, e.g., based on an automated load type selection algorithm, and in some instances based in part on analysis of various characteristics of a load placed in a wash tub by a user. Several suitable automated load type selection algorithms are described, for example, in U.S. Pat. Nos. 10,273,622, 10,612,175, and 11,371,175, as well as U.S. patent application Ser. No. 17/470,301, filed on Sep. 9, 2021 by Hooker et al., U.S. patent application Ser. No. 17/547,703, filed on Dec. 10, 2021 by Hombroek et al., and U.S. patent application Ser. No. 17/825,662, filed on May 26, 2022 by Hombroek et al. (all of which are assigned to Midea Group Co., Ltd. and are incorporated by reference herein), although it will be appreciated that other automated load type selection algorithms may be used in other embodiments. Moreover, in some embodiments, selection of a load type may be based on user input, e.g., user selection through a user interface of a particular type of load, based on a fabric and/or garment type selection, e.g., cottons, polyesters, towels, bedding, etc. In other embodiments, however, no load type selection may be performed, dynamic or otherwise, and a dynamic rinse system may be used independent of any load type selection.

In sequence 140, power on of the laundry washing machine may be performed in block 142, e.g., based upon user selection of a power button, and in block 144, an open lid may be detected. At this time, a tare weight, representative of the weight of an empty tub, may be determined in block 146. Next, in some embodiments, one or more images of the load may then be captured in block 148, with the image(s) used to determine a color composition of the load. Then, in block 150 closing of the lid may be detected. Next, a dry load weight may be determined (block 152), and then the motor that drives the wash basket may be turned on for slow rotation (block 154), e.g., at a speed of about 0 to about 100 RPM. In some embodiments, it may be desirable to determine the dry load weight while the wash basket is slowly rotating.

Next, a portion of an initial fill phase may be initiated in block 156 and a load type may be determined therefrom.

One or more wash cycle parameters are accordingly set based on the determined load type in block 158. As discussed, for example, in a number of the aforementioned cross-referenced patents and applications, a load type may be determined in some instances based at least in part on multiple times determined based upon various fluid levels sensed by a fluid level sensor during and after the dispensation of water into the wash tub. In some embodiments, the automatic and dynamic selection may be performed in response to user selection of a particular mode (e.g., an "automatic" mode), while in other embodiments, automatic and dynamic selection may be used for all wash cycles. In still other embodiments, automatic and dynamic selection may further be based upon additional input provided by a user, e.g., soil level, article type, fabric type, article durability, etc. The dynamic selection may be based in part on judging the absorptivity of the fabric in the load against the weight of the load. A dry weight may be determined for the load in some embodiments at the beginning of a washing cycle (e.g., at the beginning of the fill phase) using a weight sensor and prior to dispensing any water into the wash tub. Thereafter, water may be dispensed into the wash tub (e.g., by spraying the load to saturate the fabrics in the load), and fluid levels sensed by a fluid level sensor while dispensing water into the wash tub as well as after water dispensing has been paused or stopped may be used to determine multiple times that may be compared against various load type criteria to select a load type from among a plurality of different load types. The load type may then be used, for example, to determine if and how much additional water should be added for the initial fill, as well as other operational settings for the wash cycle.

In some embodiments, a first time at which the fluid level reaches a predetermined fluid level while dispensing water into the wash tub and a peak time at which the fluid level stabilizes after the dispensing of water into the wash tub has been stopped or paused may be used to categorize a load into one of multiple load types, as both times are affected in part by the absorbency of the articles in a load. In some instances, the first time alone may be able to categorize some loads, as, for example, the first time may be relatively short for loads containing only low absorbency fabrics such as polyesters and other synthetic materials, or may be relatively long for loads containing highly absorbent articles or fabrics such as cotton articles, bedding or towels. By incorporating the peak time into the determination, however, it has been found that additional loads may be appropriately categorized, e.g., loads where absorbency is such that the first time alone is unable to suitably categorize the load. In addition, in some embodiments, the first time may be a sense time where water is first detected by a fluid level sensor, and an additional time, e.g., a fill time at which the fluid level reaches another predetermined fluid level such as a desired minimum fill level while dispensing water into the wash tub, may also be incorporated into the determination to categorize additional loads. The dry weight of the load may also factor into the dynamic detection of load type, e.g., by determining appropriate criteria against which the times are compared.

Returning to FIG. 7, in block 160 the volumes of hot water and cold water are determined in the manner discussed above, and in block 162, the initial fill is completed by cycling the hot and cold water valves to add the determined volumes of hot and cold water. In some embodiments, and as noted above, each water valve may be cycled a single time, e.g., with the hot water valve cycled before the cold water valve, such that the hot water valve is cycled once during the initial fill operation and the cold water valve is cycled twice.

Next, in block 164, the wash cycle thereafter proceeds with one or more wash phases. The remainder of the wash cycle then proceeds with one or more rinse phases (block 166) and one or more spin phases (block 168). The wash cycle is then complete, and the system is reset (block 170).

As noted above, the determination of the volumes of hot water and cold water may be based in part on temperatures for the hot water and cold water respectively dispensed by the hot water valve and cold water valve. In addition, where no flow meters are utilized in a laundry washing machine, control over the hot water valve and cold water valve to dispense these determined volumes may be based in some embodiments at least in part on times or durations of activation that are determined based upon the flow rates of these valves.

In some embodiments, these temperatures and flow rates may be estimated values, e.g., based upon average household hot and cold water temperatures, or in some instances, based upon weather or seasonally-adjusted average hot and cold water temperatures. In other embodiments, however, a calibration operation may be performed to determine temperatures and/or flow rates, and thereby tailor the volume calculations for a particular laundry washing machine installation. Such an operation may be performed, for example, during initial set up of a laundry washing machine, e.g., after the laundry washing machine has been installed and connected to the water supply and drain. Alternatively, such an operation may be performed at other times, e.g., on-demand, such as when selected via a user interface.

Figure 8:
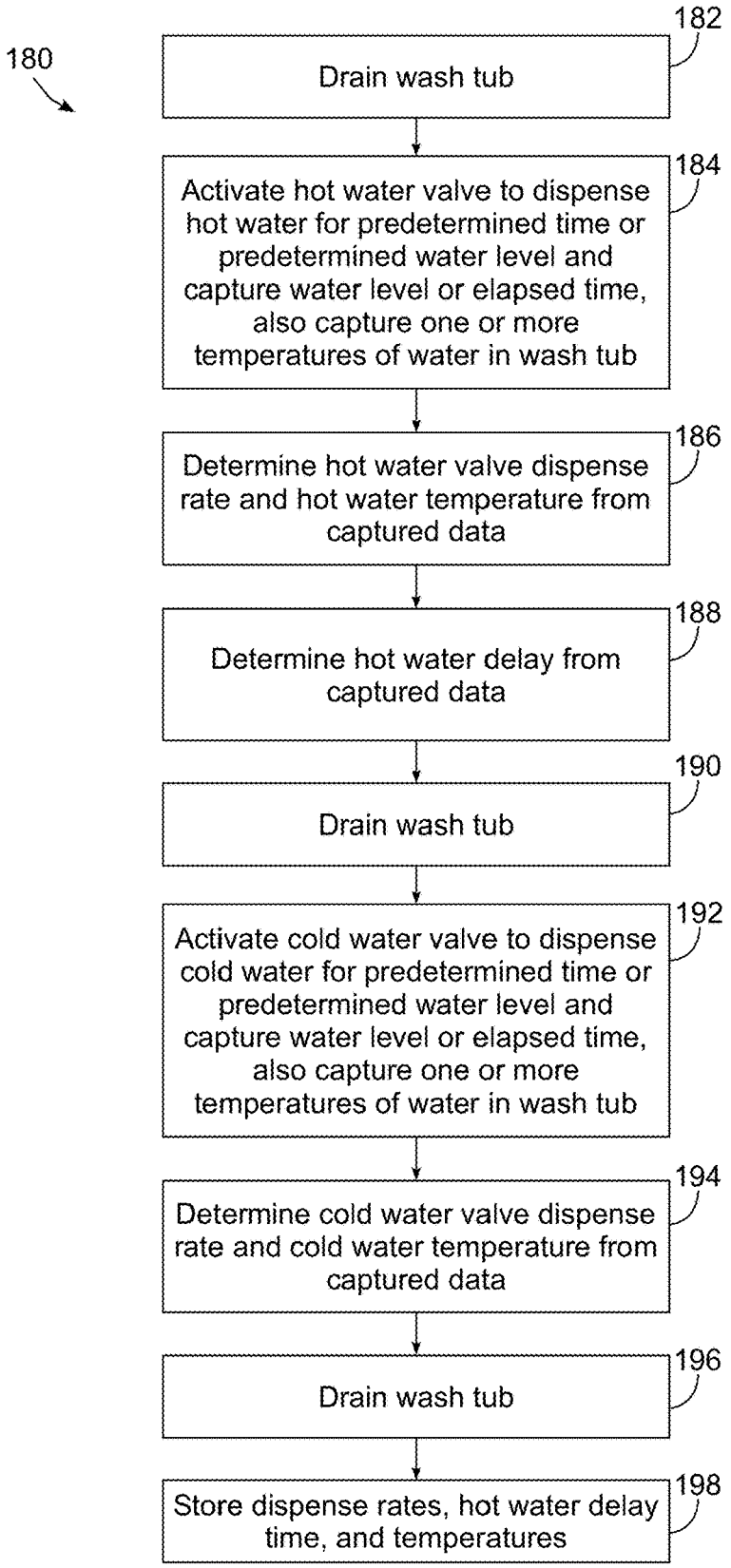
FIG. 8 is a flowchart illustrating an example operational sequence for a calibration operation capable of being performed by the laundry washing machines of FIGS. 1-4.

FIG. 8 illustrates an example implementation of a calibration operation 180, which may utilize one or more temperature sensors to sense temperature, e.g., within a wash tub, or at other suitable positions such as within the water inlet. The calibration operation 180 may also utilize one or more fluid level sensors suitable for sensing the level of fluid in the wash tub. It will be appreciated that flow rate generally may be determined by determining a change in water volume in the wash tub over time, so assuming that a known mapping exists between volume and fluid level in a particular wash tub design, a flow rate may be determined by determining a change in fluid level sensed by a fluid level sensor over time.

Calibration operation 180 begins in block 182 by activating the drain to empty the wash tub and ensure that no residual water remains in the wash tub. Next, in block 184, the hot water valve is activated to dispense a volume of hot water into the wash tub while capturing one or more fluid levels with the fluid level sensor, from which may be determined a rate of level change in the wash tub, which may then be used to determine the flow rate for the hot water valve. In some embodiments, for example, hot water may be dispensed for a predetermined time, and the fluid level sensed in the wash tub may be sensed at one or more points during this time such that a flow rate may be determined therefrom. Alternatively, hot water may be dispensed until a predetermined fluid level is reached in the wash tub, and the elapsed time to reach the predetermined fluid level may be determined such that a flow rate may be determined therefrom. In addition, during the dispensing of hot water, one or more temperatures may be captured using the one or more temperature sensors, with averaging used in some embodiments if desired. Next, in block 186, the hot water valve dispense rate and hot water temperature may be determined from the aforementioned captured data.

Next, in block 188, the captured temperature data may also optionally be used to determine a hot water delay time. As noted above, the amount of time that it takes for hot water in a hot water heater to reach the laundry washing machine may vary from installation to installation (e.g., if the hot water heater is in the basement, the amount of time for the hot water to reach a laundry washing machine also in the basement will generally be far shorter than for a laundry washing machine on the second story). Thus, by tracking the time duration between when dispensing starts and a water temperature above a predetermined threshold is reached, and based upon the calibrated flow rate, the volume of cold water that will necessarily be dispensed into the laundry washing machine when the hot water valve is first activated may be compensated for in the manner described above.

Next, in block 190, the wash tub is drained, and blocks 192 and 194 repeat a similar process as is used in blocks 184 and 186, but instead activating the cold water valve to determine a cold water valve dispense rate and cold water temperature. Next, in block 196, the wash tub is again drained, and in block 198, the determined dispense rates, hot water delay time and temperatures are stored for future use in automatic temperature control as described herein.

It will be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A laundry washing machine, comprising:

a wash tub disposed within a housing;

a water inlet configured to dispense water into the wash tub, the water inlet including a hot water valve and a cold water valve respectively configured to control a flow of hot water and a flow of cold water into the wash tub;

a weight sensor positioned to sense at least a portion of a weight associated with the wash tub; and a controller coupled to the water inlet and the weight sensor, the controller configured to:

determine a weight associated with the wash tub using the weight sensor after a load has been added to the wash tub, determine a target temperature of water to be added to the wash tub, determine, based at least in part on the determined weight associated with the wash tub, a volume of hot water and a volume of cold water to be added to the wash tub to provide the determined target temperature of water in the wash tub, and control the hot water valve and the cold water valve during a wash cycle to respectively add the determined volume of hot water and determined volume of cold water to the wash tub.

2. The laundry washing machine of claim 1, wherein the controller is configured to determine the weight associated with the wash tub by determining a weight of the load added to the wash tub.

3. The laundry washing machine of claim 1, wherein the controller is further configured to determine a total volume of water to be added to the wash tub based at least in part on the determined weight of the load.

4. The laundry washing machine of claim 3, wherein the controller is configured to determine the total volume of water to be added to the wash tub based at least in part on the determined weight of the load using a polynomial function including a plurality of empirically determined coefficients.

5. The laundry washing machine of claim 3, wherein the controller is further configured to dynamically select a load type for the load added to the wash tub from among a plurality of load types, and to determine the target temperature based at least in part on the dynamically selected load type.

6. The laundry washing machine of claim 5, further comprising a fluid level sensor configured to sense a fluid level in the wash tub, wherein the controller is further configured to initiate an initial fill phase of the wash cycle by controlling the water inlet to dispense water into the wash tub and to dynamically select the load type during the initial fill phase of the wash cycle.

7. The laundry washing machine of claim 6, wherein the controller is configured to dynamically select the load type based at least in part on a first time at which the fluid level sensor senses a predetermined fluid level while the controller controls the water inlet to dispense water into the wash tub and a peak time at which the fluid level sensor senses a stabilization of fluid level after the controller controls the water inlet to stop dispensing water into the wash tub.

8. The laundry washing machine of claim 6, wherein the controller is configured to control the water inlet to dispense an initial volume of water into the wash tub in association with dynamically selecting the load type.

9. The laundry washing machine of claim 8, wherein the controller is configured to:

dispense the initial volume of water by controlling the cold water valve to dispense the initial volume of water; and thereafter dispense the determined total volume of water to be added to the wash tub by:

controlling the hot water valve to add the determined volume of hot water to the wash tub; and thereafter controlling the cold water valve to add the determined volume of cold water to the wash tub.

10. The laundry washing machine of claim 9, wherein the controller is configured to dispense the initial volume of water and dispense the determined total volume of water to be added to the wash tub by cycling the hot water valve and the cold water valve a maximum of three times.

11. The laundry washing machine of claim 8, wherein the controller is configured to determine the volume of hot water using the equation:

$$V_{hot} = \frac{(T_{target} * (V_{initial} + V_{total})) - (T_{cold} * V_{initial}) - (T_{cold} * V_{total})}{-T_{cold} + T_{hot}}$$

where $V_{hot}$ is the determined volume of hot water, $T_{target}$ is the target temperature, $V_{initial}$ is the initial volume of water, $V_{total}$ is the determined total volume of water to be added to the wash tub, $T_{cold}$ is a temperature of the cold water supplied by the cold water valve, and $T_{hot}$ is a temperature of the hot water supplied by the hot water valve.

12. The laundry washing machine of claim 11, wherein the controller is configured to determine the volume of cold water using the equation:

$$V_{cold}=V_{total}\ V_{hot}.$$

13. The laundry washing machine of claim 1, wherein the controller is configured to determine the volume of hot water and to determine the volume of cold water using an estimated temperature of the hot water dispensed by the hot water valve and an estimated temperature of the cold water dispensed by the cold water valve.

14. The laundry washing machine of claim 1, wherein the controller is configured to determine the volume of hot water and to determine the volume of cold water using a hot water delay representing a duration or volume of non-hot water being dispensed upon initial activation of the hot water valve.

15. The laundry washing machine of claim 1, further comprising one or more temperature sensors configured to sense a temperature of the hot water dispensed by the hot water valve and a temperature of the cold water dispensed by the cold water valve, and wherein the controller is configured to perform a calibration operation to determine a temperature of the hot water dispensed by the hot water valve and determine a temperature of the cold water dispensed by the cold water valve using the one or more temperature sensors.

16. The laundry washing machine of claim 15, wherein the controller is configured to perform the calibration operation by:

activating the hot water valve to dispense a first volume of hot water into the wash tub and determining the temperature of the first volume of hot water using the one or more temperature sensors;

draining the first volume of hot water from the wash tub;

activating the cold water valve to dispense a second volume of cold water into the wash tub and determining the temperature of the second volume of cold water using the one or more temperature sensors; and draining the second volume of cold water from the wash tub.

17. The laundry washing machine of claim 15, wherein the controller is further configured to perform the calibration operation by determining a hot water delay representing a duration or volume of non-hot water being dispensed upon initial activation of the hot water valve.

18. The laundry washing machine of claim 15, wherein the controller is configured to perform the calibration operation during initial setup of the laundry washing machine.

19. The laundry washing machine of claim 1, wherein the controller is configured to control the hot water valve to add the determined volume of hot water by opening the hot water valve for a first predetermined time determined based upon an estimated flow rate for the hot water valve, and to control the cold water valve to add the determined volume of cold water by opening the cold water valve for a second predetermined time determined based upon an estimated flow rate for the cold water valve.

20. The laundry washing machine of claim 1, wherein the controller is configured to control the hot water valve to add the determined volume of hot water by opening the hot water valve for a first predetermined time determined based upon a determined flow rate for the hot water valve, to control the cold water valve to add the determined volume of cold water by opening the cold water valve for a second predetermined time determined based upon a determined flow rate for the cold water valve, and to determine the determined flow rate for the hot water valve and the determined flow rate for the cold water valve by:

activating the hot water valve to dispense a first volume of hot water into the wash tub, determining a first rate of level change in the wash tub using a fluid level sensor configured to sense a fluid level in the wash tub, and determining the determined flow rate for the hot water valve from the determined first rate of level change;

draining the first volume of hot water from the wash tub;

activating the cold water valve to dispense a second volume of cold water into the wash tub, determining a second rate of level change in the wash tub using the fluid level sensor, and determining the determined flow rate for the cold water valve from the determined second rate of level change; and draining the second volume of cold water from the wash tub.

21. A laundry washing machine, comprising:

a wash tub disposed within a housing:

a fluid level sensor configured to sense a fluid level in the wash tub;

a water inlet configured to dispense water into the wash tub, the water inlet including a hot water valve and a cold water valve respectively configured to control a flow of hot water and a flow of cold water into the wash tub; and a controller coupled to the water inlet and the weight sensor, the controller configured to perform a wash cycle for a load disposed in a wash tub by:

initiating an initial fill phase of the wash cycle by controlling the water inlet to dispense a first volume of water into the wash tub;

dynamically selecting a load type for the load during the initial fill phase;

determining a target temperature for water in the wash tub based at least in part on the dynamically selected load type;

determining a total volume of water to be added to the wash tub after the first volume of water has been added to the wash tub;

determining a volume of hot water and a volume of cold water to be added to the wash tub based at least in part upon the determined target temperature and the determined total volume of water to be added to the wash tub; and controlling the hot water valve and the cold water valve to respectively add the determined volume of hot water and determined volume of cold water to the wash tub.

* * * * *